US005248066A

United States Patent [19]

Olson et al.

[11] Patent Number: 5,248,066

[45] Date of Patent: Sep. 28, 1993

[54] LIQUID DISPENSER WITH COLLAPSIBLE RESERVOIR HOLDER

[75] Inventors: John T. Olson, Chisago City; Gerald L. Burns, Eagan, both of Minn.; Stanley R. Weller, Marietta, Ga.

[73] Assignee: Ecolab Inc., St. Paul, Minn.

[21] Appl. No.: 858,611

[22] Filed: Mar. 27, 1992

[51] Int. Cl.[5] ..... B65D 353/56

[52] U.S. Cl. ..... 222/105; 222/181; 222/214

[58] Field of Search ..... 222/105, 154, 156, 181, 222/183, 185, 325, 214, 207

[56] References Cited

U.S. PATENT DOCUMENTS

| | | | |
|---|---|---|---|
| 3,241,726 | 3/1966 | Chester | 222/211 |
| 3,248,013 | 4/1966 | Bekhor | 222/100 |
| 3,685,680 | 8/1972 | Tenckhoff et al. | 222/27 |
| 3,756,471 | 9/1973 | Wissman | 222/156 |
| 3,870,201 | 3/1975 | Asplund | 222/207 |
| 3,881,641 | 5/1975 | Pliml et al. | 222/207 |
| 4,101,057 | 7/1978 | LoMaglio | 222/207 |
| 4,178,975 | 12/1979 | Crespi | 141/362 |
| 4,238,056 | 12/1980 | Tucker et al. | 222/181 |
| 4,349,133 | 9/1982 | Christine | 222/183 |
| 4,515,294 | 5/1985 | Udall | 222/214 |
| 4,570,827 | 2/1986 | Roggenburg et al. | 222/95 |
| 4,621,749 | 11/1986 | Kanfer | 222/214 |
| 4,667,854 | 5/1987 | McDermott et al. | 222/101 |
| 4,784,297 | 11/1986 | Katz | 222/185 |
| 5,102,015 | 4/1992 | Barnard et al. | 222/214 |

*Primary Examiner*—Andres Kashnikow
*Assistant Examiner*—Philippe Derakshani
*Attorney, Agent, or Firm*—Merchant, Gould, Smith, Edell, Welter & Schmidt

[57] ABSTRACT

A dispenser (10) for use particularly with viscous liquids which has a housing (11) having positioned therein a reservoir holder (31) demountably attached to the housing (11), a collapsible reservoir (26) disposed in the holder (31), a dispensing tube (27) extending from the reservoir (26), and a front push bar member (35) which when pushed, causes a block member (22) inside of the housing (11) to contact the dispensing tube (27) and thereby dispense a predetermined controlled amount of liquid.

29 Claims, 6 Drawing Sheets

LIQUID DISPENSER WITH COLLAPSIBLE RESERVOIR HOLDER

FIELD OF THE INVENTION

The invention relates to dispensers for liquid materials. More specifically, the invention relates to an improved dispenser constructed to house a collapsible reservoir or bag containing a liquid, with the reservoir disposed in a holder within the dispenser which is demountably attached to the dispenser.

BACKGROUND OF THE INVENTION

Liquid dispensers are well known and are in substantial commercial use. Such dispensers are utilized to deliver viscous liquids such as liquid soaps, hand lotion, creams and the like. Key requirements for such dispensers are delivery of metered amounts of product upon actuation of the dispenser without leakage from the dispensing tube, prevention of contamination, reduction in the difficulty in cleaning or replacing the liquid container, and eliminating entrapment of air and other undesirable features.

In prior dispensers, the viscous liquid is supplied and held within the dispenser in a variety of ways. For example, in some dispensers, it is necessary to pour bulk soap into the dispenser directly, while in other dispensers a bag of liquid to be dispensed is hung from hooks or pins within the dispenser. In other dispensers, a reservoir or bag of liquid material such as soap is provided in an outer casing such as a cardboard box container which is placed upon a support structure within the dispenser.

A variety of such dispensers have been disclosed in various U.S. patents. For example, McDermott, et al., U.S. Pat. No. 4,667,854, discloses a liquid dispenser such as a liquid hand soap dispenser which utilizes a collapsible reservoir or bag for the liquid within the dispenser housing, in which the collapsible bag is contained within an outer casing such as a cardboard box to provide support for the collapsible bag. In Roggenburg, Jr., et al., U.S. Pat. No. 4,570,827, a liquid dispenser is disclosed which includes a flexible bag which is formed with two chambers, a supply chamber and a discharge chamber, and the bag is suspended in the housing of the dispenser from projecting pins. Christine, U.S. Pat. No. 4,349,133, discloses a dispenser that includes a housing in which is mounted a disposable container holding liquid materials, in which the container is of accordion-type construction and is placed directly within the housing on support elements or shelves attached to the housing.

Other examples of prior dispensers include Tucker, et al., U.S. Pat. No. 4,238,056, which discloses a soap dispenser having a soap reservoir comprising a sump and a container, in which the reservoir container is supported inverted on the reservoir sump emptying downwardly therein, and the container is preferably a plastic bottle of a particular configuration to be positioned within the dispenser cabinet in an inverted position. In Pliml, Jr., et al., U.S. Pat. No. 3,881,641, a dispensing device is disclosed for discharging a quantity of flowable material such as food condiments, which includes a plastic bag containing the material to be dispensed, with the bag hung from a support hook located on a wall panel forming part of the structure of the dispensing apparatus. Asplund, U.S. Pat. No. 3,870,201, discloses an apparatus for dispensing a paste product comprising a container with an elastic outlet tube, a casing surrounding the container and a push means for acting on the outlet tube for pressing out the product from the container.

The above patents disclose various dispensers which house bags or containers for viscous materials such as liquid soap and various mechanisms for supporting the bags within the dispenser. However, prior dispensers have exhibited one or more disadvantages such as difficulty in replacing the liquid reservoir, liquid dripping, opportunity for bacterial contamination, the handle pulling action serving to pull the dispenser from the mounting, potential for entrapping air, etc. Also, use of small disposable boxes in housing a collapsible reservoir or bag such as disclosed in U.S. Pat. No. 4,667,854 increases the waste material to be disposed of once the reservoir is depleted of its contents since both the box and reservoir are discarded.

Therefore, there is a need for an improved dispenser having a reservoir or bag holder which overcomes the above disadvantages. Various objects and advantages of the invention will become apparent from the following description thereof.

SUMMARY OF THE INVENTION

It has now been discovered that an improved liquid dispenser can be obtained through the introduction of several key elements. The invention includes a holder for supporting a flexible, collapsible reservoir disposed within a liquid dispenser such as a liquid hand soap dispenser. The reservoir holder is preferably a plastic shell which can enclose and support the collapsible reservoir or bag of a viscous liquid such as liquid hand soap. The reservoir holder comprises a front wall section, a pair of opposing spaced side wall sections positioned proximate to the front wall section, a bottom wall section positioned proximate to the front wall and the side wall sections, with the bottom wall section having an aperture formed therein, and means for demountably attaching the holder to the dispenser. The front wall, side wall and bottom wall sections are operatively connected to form the reservoir holder. The front and side wall sections define an upwardly disposed access port through which the reservoir can be removed for disposal when empty and replaced with a full reservoir. The reservoir holder is demountably or releasably attached to the dispenser within a storage portion by any suitable means such as a molded-in catch or latch. In a preferred embodiment, an opening is formed in the front wall section of the holder to provide for easy loading of a reservoir or bag dispensing tube, and the opening also allows for viewing by a user through a dispenser window to see if the liquid material has been depleted from the reservoir.

The invention also includes a liquid dispenser in combination with the above reservoir holder to form an improved dispensing system. A preferred dispenser generally comprises a housing, a reservoir holder demountably attached to the housing in a storage portion thereof, a reservoir disposed in the holder having affixed thereto a dispensing tube for retaining and delivering the liquid, and a front push bar member which is pushed to effect a block member which contacts the dispensing tube for dispensing a metered amount of liquid. The pushing action on the bar member prevents the dispenser from being accidentally pulled from its mounting. The tube is in a constant pinched position during delivery of the liquid material so there is no opportunity for entrapped air, the latter serving to reduce the volume of delivered liquid and allowing for the possible transfer of bacteria into the reservoir. Preferably, a unitary nozzle tip on the dispensing tube is employed to prevent dripping and clogging, thereby assuring greater cleanliness, elimination of an environment for bacterial growth, and provides consistent performance. A viewing window is preferably employed in the front of the dispenser housing which enables a user to see if the viscous liquid such as soap has been depleted from the bag.

The present invention is an improvement over prior dispensers which employed a box encasing a bag of liquid material such as hand soap. The reservoir holder of the present invention eliminates the need of a box for every bag of soap required in some prior dispensers. The reservoir holder of the invention reduces disposable waste since the supporting box encasing the reservoir or bag of soap is eliminated. The holder of the invention also maximizes the use of plastic to make the collapsible reservoir or bag in that less plastic is used to make the bags which fit in the holder, resulting in less waste material once the soap has been depleted from the bag. The invention also reduces production costs permitting a lower priced product to be produced.

One aspect of the invention is the novel reservoir holder which can be employed in liquid dispensers. A further aspect of the invention is a liquid dispensing system employing the reservoir holder. To the accomplishment of the above, and to such other objects as may hereinafter appear, the present invention is defined in the appended claims and described in the specification, taken together with the accompanying drawings.

DETAILED DESCRIPTION OF THE INVENTION

The invention includes a holder for a collapsible reservoir in a liquid dispenser, in which the holder can be demountably attached to the dispenser such as a liquid hand soap dispenser. The invention also includes a liquid dispenser in combination with a reservoir holder disposed therein to form an improved dispensing system. In operation, a disposable reservoir or bag containing a liquid material to be dispensed is placed inside of a holder deployed in a dispenser, with a dispensing tube protruding downwardly from an opening in the holder.

The drawings depict various preferred embodiments of the invention which can be formed in a variety of ways. While the description will proceed with respect to such drawings, it will be readily understood by those skilled in the art that such descriptions and drawings are used to explain the novel features of this invention, rather than in any limiting sense.

Figure 1:
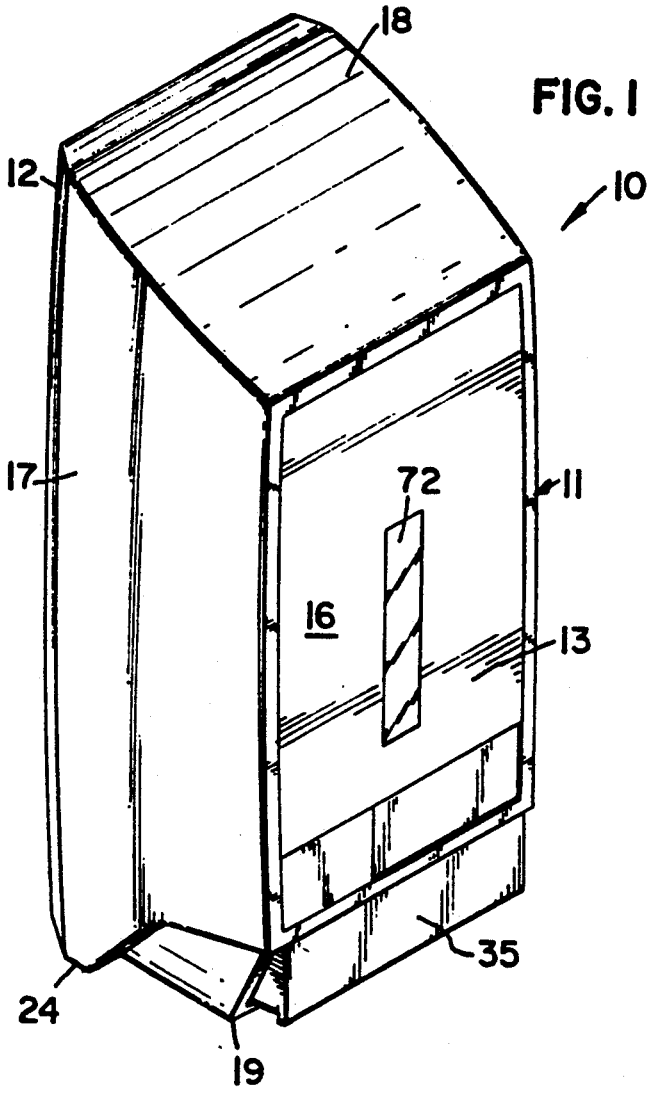
FIG. 1 is a front left perspective view of the dispenser of the instant invention.

Referring in detail to the drawings, FIG. 1 depicts the dispenser 10 of the present invention that includes housing 11 with a back portion 12 and a cover 13. The back portion 12 (see FIG. 7) includes a rear wall 14 that can be secured to a suitable supporting structure such as a wall by means of conventional securing means such as screws, adhesives, adhesive tapes and the like. Locking means 15 is also positioned in rear wall 14, the locking means 15 being described in greater detail hereinafter. Cover 13 includes a front wall 16, spaced side walls 17, as well as top wall 18 and a bottom wall 19. As noted in FIGS. 2 and 3, the front wall 16 has a cut-out section 20 therein, while bottom wall 19 has a centrally-located opening 21, the purpose of each of these openings also being described in greater detail hereinafter. Positioned adjacent to cut-out section 20 is protruding block member 22 described in greater detail hereinafter. Cover 13 is hinged to back portion 12 by means of pins 23 inserted between cover member extensions 24 and back portion extension 25. A viewing window 72 is preferably employed in cover 13 which enables a user to see if the viscous liquid such as soap has been depleted from the reservoir or bag disposed therein.

Figure 3:
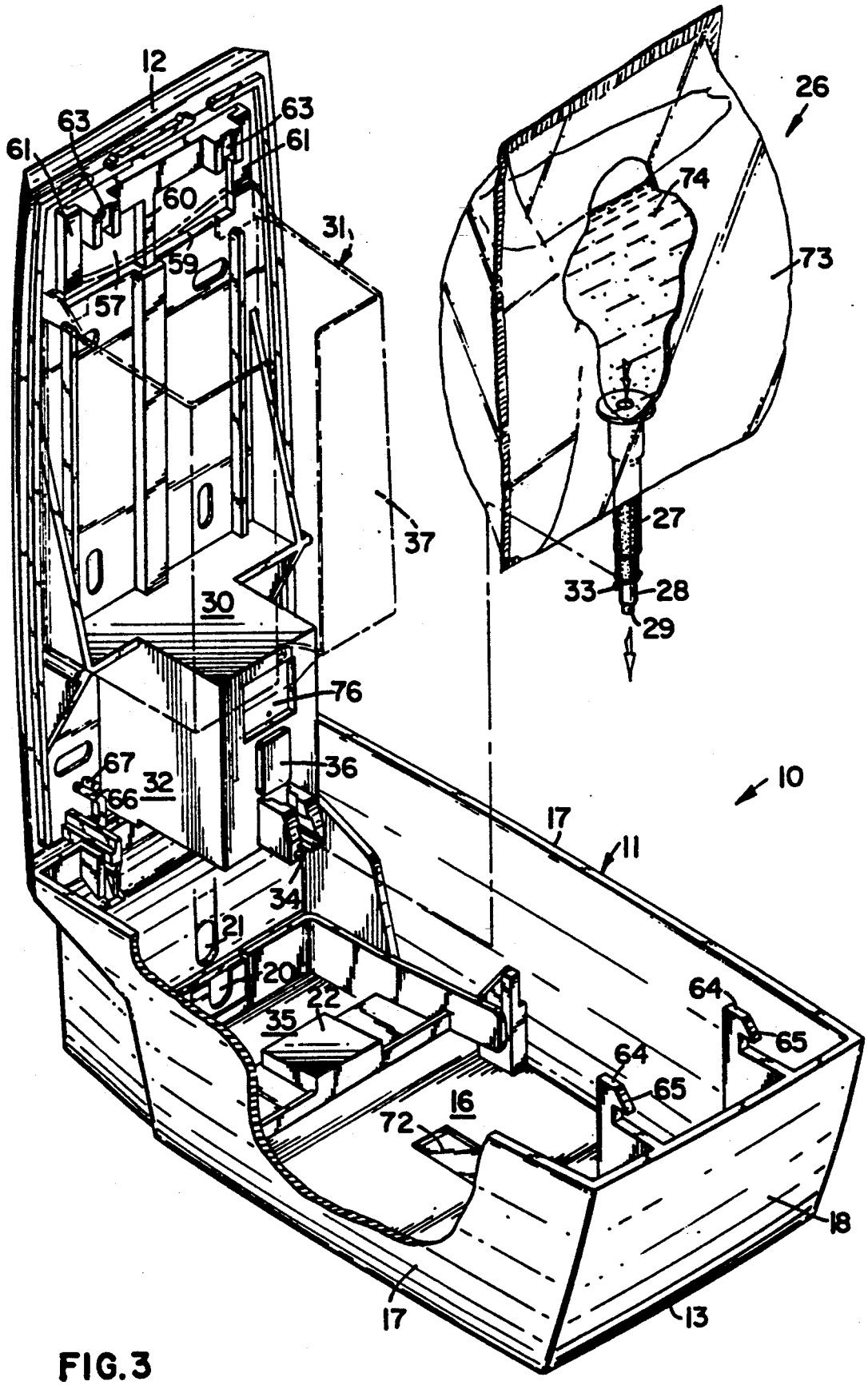
FIG. 3 is an exploded perspective view showing the dispenser in an opened position.
Figure 8:
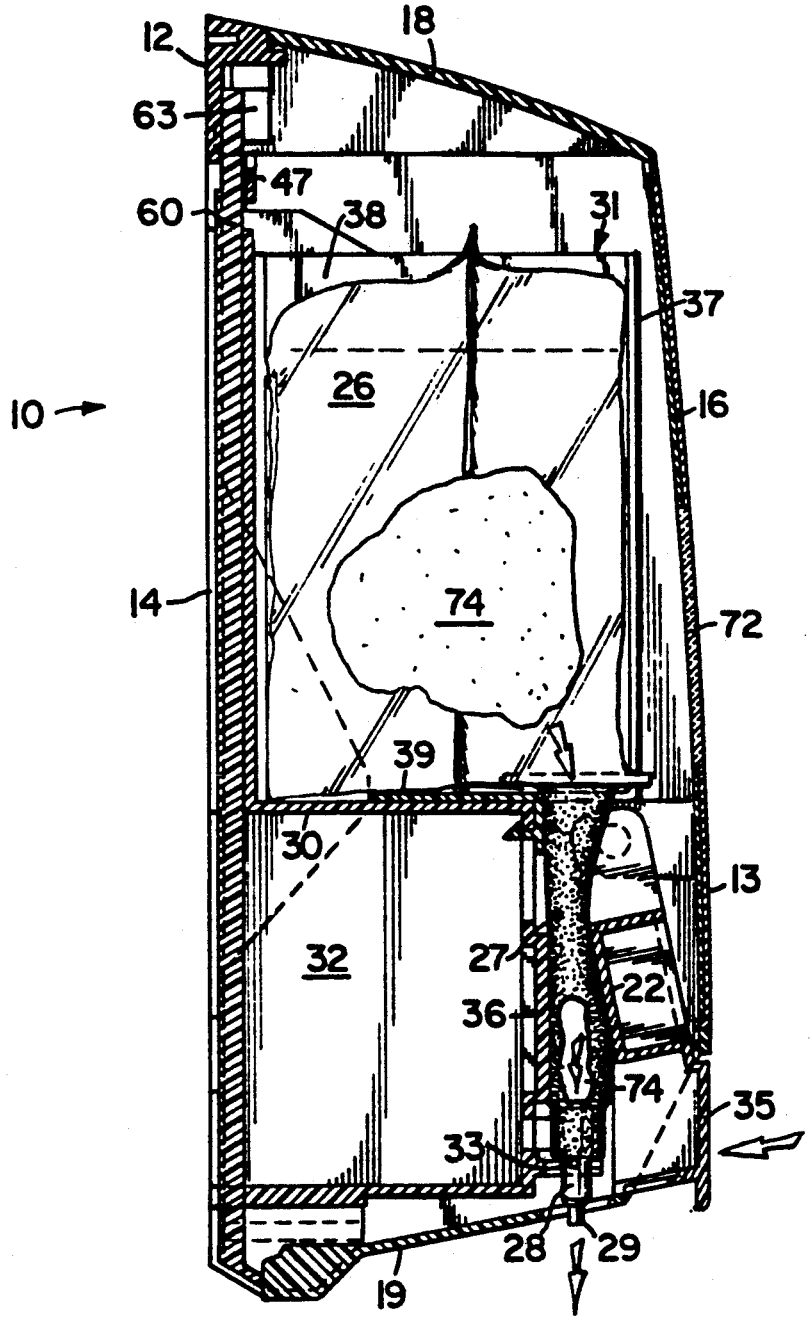
FIG. 8 is a cross-sectional view of the dispenser taken generally along Lines 8—8 of FIG. 7.

Referring to FIGS. 3 and 8, removably disposed within the housing 11 is liquid reservoir 26, preferably formed of a collapsible plastic bag 73, which has a quantity of flowable material 74 such as liquid soap disposed therein. Reservoir 26 has a flexible dispensing tube 27, preferably tapered downward, attached to the lower portion thereof. Tube 27 is arranged to receive a discharge nozzle 28 with tip 29 at the dispensing (downstream) end thereof, the nozzle 28 being either an extraneously fixed member or an integral part of the tube 27. A valve means (not shown) positioned in the downstream end of the tube 27 but set back from the nozzle tip 29, combines with the small tip opening and liquid surface tension to prevent leakage of the liquid through nozzle 28 when the dispenser is not in use. Typical valve means may be any one-way valve such as a ball and spring combination. The flexible tube 27 is held in place and positioned for discharge of liquid material by support member 32 and by the insertion of nozzle flange 33 into slot 34. When so positioned, nozzle 28 and tip 29 protrude from opening 21, in order to dispense the liquid material 74 from the reservoir to the user.

Figure 5:
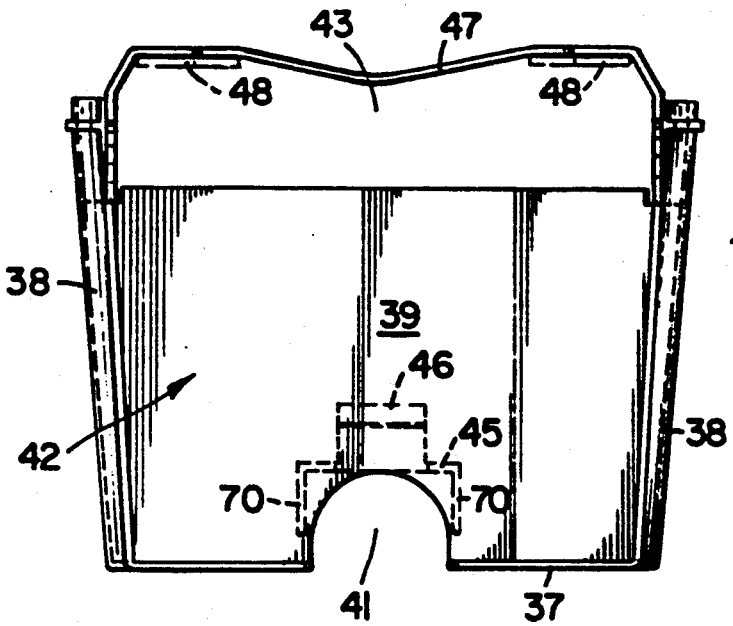
FIG. 5 is a top plan view of the reservoir holder depicted in FIG. 4.
Figure 4:
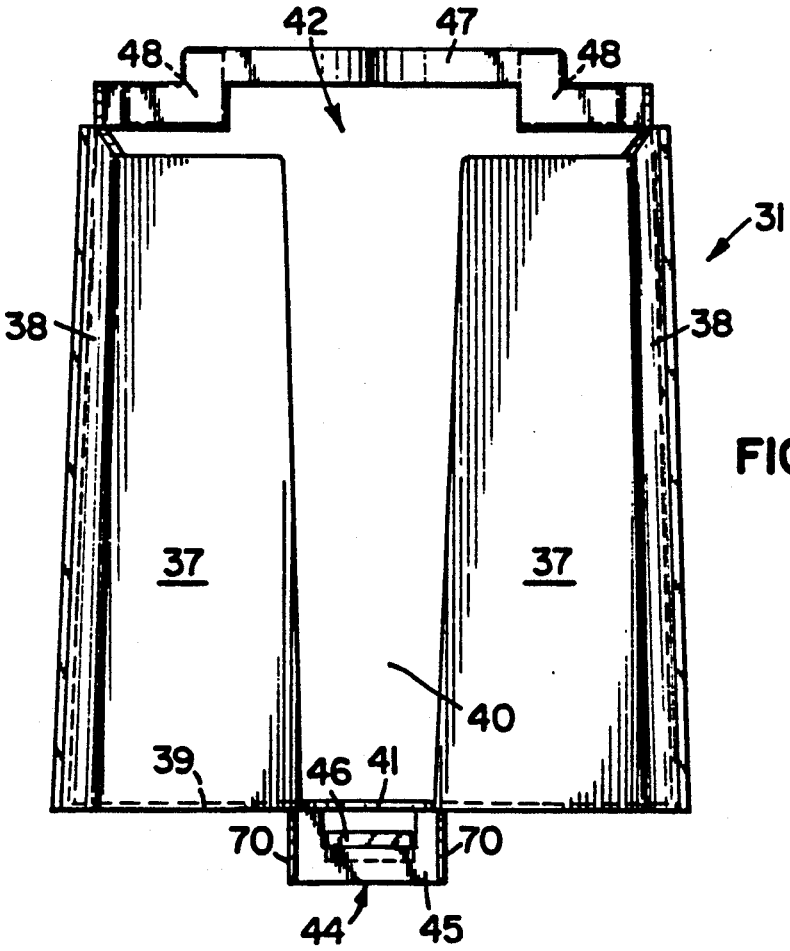
FIG. 4 is a front elevational view of the reservoir holder of the invention.
Figure 6:
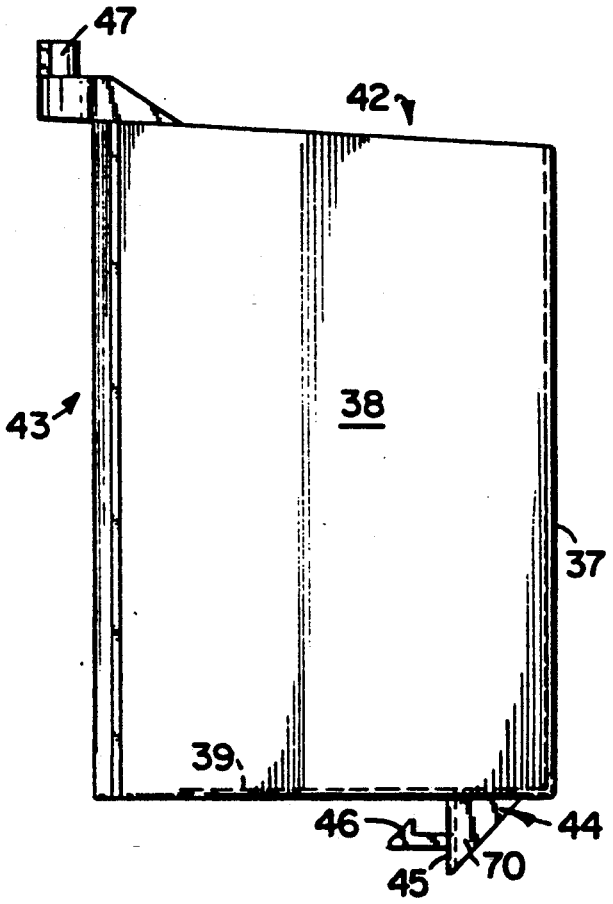
FIG. 6 is a side elevational view of the reservoir holder depicted in FIG. 4.

The reservoir 26 is contained and supported within a holder 31 shown in phantom view in FIG. 3. Holder 31 is maintained in a storage portion of housing 11 by support from ledge 30 of support member 32 affixed to an interior surface of back portion 12. The holder 31 is demountably attached to support member 32 and back portion 12 by any suitable attaching means. The construction of holder 31 will be described as follows with reference to FIGS. 4-6. The holder 31 includes a front wall section 37, opposing spaced side wall sections 38 and a bottom wall section 39 which are all operatively connected to form holder 31. Front wall section 37 preferably has an opening 40 formed therein, while bottom wall section 39 has a semi-circular aperture 41 contiguous with opening 40. The top portion of the front and side wall sections 37, 38 defines an upwardly disposed access port 42 which is preferably open, however, a lid (not shown) can be attached to the top portion to cover the access port 42 of holder 31. The rear portion 43 is also preferably open since the inner surface of back portion 12 forms the back wall for the holder 31. However, a back wall (not shown) can be employed which is attached to side wall sections 38, if desired. An attaching means 44 such as a molded-in catch or latch protrudes from bottom wall section 39 so that holder 31 may be demountably or releasably connected to support member 32. Attaching means 44 provides a semi-permanent attachment of holder 31 to dispenser 10. Preferably, attaching means 44 is a latch having a generally downwardly protruding member 45 having triangular support structures 70, and a hook member 46 protruding toward rear portion 43. Hook member 46 snaps onto support member 32 through an upper opening 76 in support member 32 to aid in securing holder 31 to the dispenser 10. Preferably, a connecting strap 47 is fixedly attached to side wall sections 38 across top portion 42. Strap 47 is releasably connected to back portion 12 by sliding it into retention members 61, described hereinafter, thereby securing holder 31 to back portion 12 of dispenser 10. Tabs 48 may be attached to strap 47 to provide increased pressure between strap 47 and retention members 61.

Reservoir holder 31 can be molded in one unitary piece through use of conventional plastic molding techniques. A variety of plastic polymeric materials can be utilized in fabricating holder 31 such as polyethylene, polypropylene, acrylonitrile/butadiene/styrene terpolymer (ABS), etc. A preferred plastic material is polypropylene.

Figure 2:
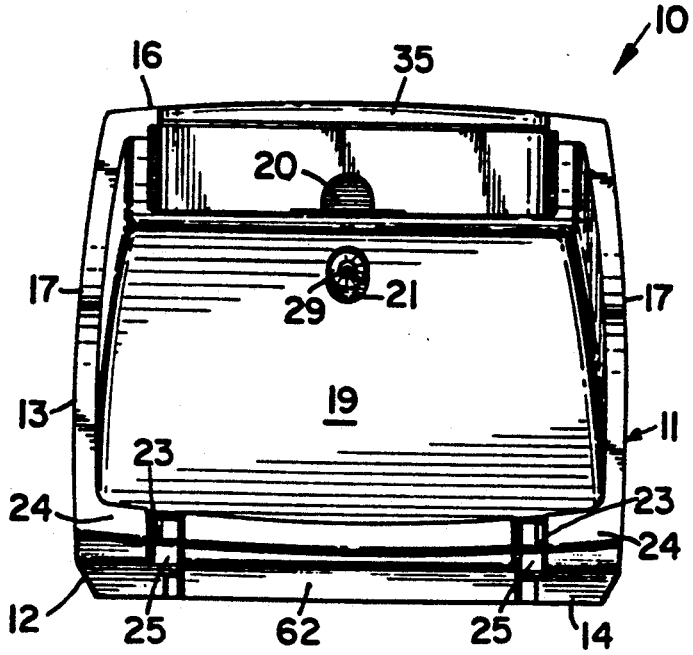
FIG. 2 is a bottom plan view of the dispenser depicted in FIG. 1.

As noted in FIGS. 2 and 8, the dispensing mechanism includes front push bar member 35 which protrudes through cut out section 20 when housing 11 is in a closed position. Push bar member 35 is rotatably attached to the inside of cover 13 and has a block member 22 protruding therefrom inside of housing 11. In relaxed position, block member 22 is in a slightly pinched engagement with tube 27 in order to aid in preventing air entrapment as shown in FIG. 8. Block member 22 is preferably angled to apply pressure downwardly on the tube 27 as push bar 35 is pressed in.

From the foregoing, it will be seen that when dispenser 10 is being used, the reservoir 26 containing the material 74 to be dispensed is positioned in housing 11 within holder 31 as shown in FIG. 8. As pressure is applied to push bar 35, block member 22 is urged against flexible tube 27 at the upstream end thereof. The pressure of block member 22 forcing tube 27 against the front of support member 32, having a raised pad 36 disposed thereon, closes off the tube 27. The pressure at the initiation of the stroke is necessarily greater than at any other point of the cycle in order to close off the tube 27 and also to provide sufficient velocity to the liquid as compensation for the short stroke. The continuous application of pressure on push bar 35 causes block member 22 to apply pressure on the tube 27 toward the downstream end thereof. As block member 22 presses against tube 27, it continues pressing tube 27 against pad 36 of support member 32 so that as a result, the liquid contained in the tube is discharged through nozzle tip 29. At the end of the forward stroke and the release of push bar 35, block member 22 will return to its original position. Thus, a predetermined amount of liquid will be dispensed each time for each operating stroke inasmuch as the length of tube 27 squeezed is uniform for each operating stroke. Tube 27 returns to its substantially round shape, causing a slight vacuum therein such that tube 27 fills almost instantaneously and the next shot of liquid material can be discharged immediately. As noted previously, block member 22 does not completely disengage from tube 27 so as to aid in preventing the entrapment of air in tube 27.

Figure 7:
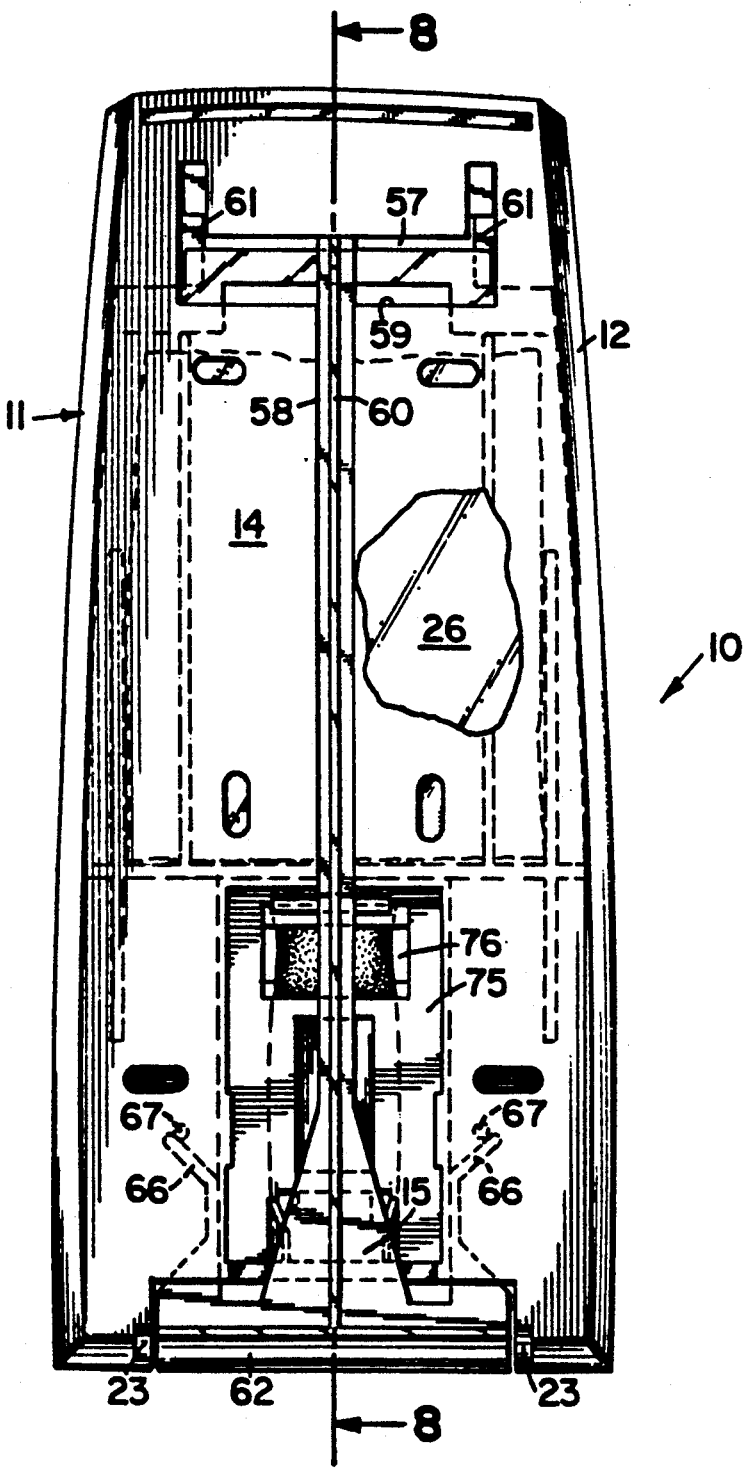
FIG. 7 is a rear elevational view of the dispenser depicted in FIG. 1.

With regard to the locking means 15, reference is made to FIGS. 3 and 7 whereby in back portion 12, cut-out section 57, lock channel 58, shoulder 59 and a cut-out portion 75 at the bottom of back 12 provide the movement path and retention means for elongated latch 60. In addition, retention members 61 provide a further path for the movement of the upper portion of latch 60. Elongated latch 60 comprises at its lower end push member 62 and at its upper end receiving means 63. Thus, in order to open the dispenser, force is applied to push member 62, thereby raising latch 60 and disengaging receiving means 63 from hooks 64 fixedly attached to the interior of cover 13. Likewise, closing the dispenser involves pivoting back portion 12 toward cover 13 such that the beveled edges 65 on hooks 64 will encounter receiving means 63 thereby raising latch 60 and permitting hooks 64 to be engaged in receiving means 63. Flexible members 66 in contact with stops 67 provide the spring-like action to permit the raising and locking action. A further advantage of the instant dispenser is that latch 60 is an independent unit, totally removable to facilitate molding and assembly.

The parts of the dispenser can be made from any suitable material such as various plastic materials which can be molded in a typical plastic molding operation. The reservoir 26 is generally of the disposable type and can be made of a variety of different plastic materials. Preferably polyethylene or polypropylene is utilized in making the disposable reservoir. A particularly preferred material for the bag or reservoir is a nylon polyethylene laminate supplied for example by Columbus Packaging Company or other vendors. The bag or reservoir collapses as the liquid is dispensed and then can be readily replaced when emptied by a new reservoir. Tube 27 is made of a flexible material that is characterized by its recovery characteristics such as various elastomeric polymers. The collapsible reservoir and flexible tube allow for ease in shipment and storage. Replacing reservoir 26 merely involves opening back portion 12 by pivoting it around pins 23 so that cover 13 can be swung open, removing the empty reservoir from the holder 31 through the access port 42, disengaging nozzle flange 33 from slot 34, then inserting a full reservoir in the same manner and closing cover 13 so that it locks against back portion 12.

The present dispensing system is an improvement over prior dispensers which employed a box encasing a bag of liquid material such as hand soap. The reservoir holder of the present invention eliminates the need of a box for every bag, thereby reducing disposable waste since the supporting box is eliminated. Operating labor is reduced in that the bag does not have to be changed as often within the dispenser since the bag size may be increased from prior bag sizes when the holder is employed. The holder of the invention also maximizes the use of plastic to make the collapsible reservoir or bag in that less plastic is used to make the bags which fit in the holder, resulting in less waste material once the soap has been depleted from the bag.

The present dispensing system is adapted to be used in a wide variety of applications where it is required that a metered amount of product be released upon each actuation of the dispensing mechanism. The device or system is especially suitable for use in an institutional environment inasmuch as it offers a low cost bulk package of product. The device can be actuated through very simple means and occupies a minimum amount of space and it is especially suitable to meet environmental requirements. Furthermore, the product contained within the reservoir never contacts any of the operating mechanism so there is provided a highly sanitary method of dispensing the product. The dispensing system can be in the form of a wall mounted unit, can be mounted on a pedestal, can be console mounted or suspended in an otherwise suitable location.

The foregoing discussion is illustrative of the invention. However, since many embodiments of the invention can be made without departing from the spirit and scope of the invention, the invention resides wholly in the claims hereinafter appended.

What is claimed is:

1. A reservoir holder for supporting a flexible, collapsible reservoir within a dispenser for discharging liquid materials, said holder comprising:

(a) a front wall section;

(b) a pair of opposing spaced side wall sections positioned proximate to said front wall section;

(c) a bottom wall section positioned proximate to said front wall and side wall sections, said bottom wall section having an aperture formed therein;

(d) means for demountably attaching said holder to said dispenser; and (e) a connecting strap which is fixedly attached to said opposing side walls;

wherein said front wall, side wall and bottom wall sections are operatively connected to form said holder, said front and side wall sections defining an upwardly disposed access port through which the reservoir can be removed for disposal when empty and replaced with a full reservoir.

2. The holder of claim 1, wherein said front wall section has an opening formed therein contiguous with said bottom wall aperture.

3. The holder of claim 1, wherein said holder is made of a plastic polymeric material.

4. The holder of claim 3, wherein said plastic material is polypropylene, polyethylene, or a acrylonitrile/-butadiene/styrene terpolymer.

5. The holder of claim 1, wherein said holder is molded in one unitary piece.

6. A liquid dispensing system, comprising:

(a) a dispenser for discharging a liquid material, cover attached to the back portion, and a flexible reservoir for containing the liquid, said reservoir removably disposed in a storage portion of the dispenser; and (b) a holder demountably attached to the dispenser in the storage portion for supporting the reservoir, said holding comprising:

(i) a front wall section;

(ii) a pair of opposing spaced side wall sections positioned proximate to said front wall section;

(iii) a bottom wall section positioned proximate to said front wall and side wall sections, said bottom wall section having an aperture formed therein;

(iv) means for demountably attaching said holder to said dispenser; and (v) a connecting strap on said holder which is fixedly attached to said opposing side walls, said strap releasably connected to said back portion of said dispenser;

wherein said front wall, side wall and bottom wall sections are operatively connected to form said holder, said front and side wall sections defining an upwardly disposed access port through which the reservoir can be removed for disposal when empty and replaced with a full reservoir.

7. The dispensing system of claim 6, wherein said front wall section of said holder has an opening formed therein contiguous with said bottom wall aperture.

8. The dispensing system of claim 6, wherein said holder is made of a plastic polymeric material.

9. The dispensing system of claim 6, wherein said plastic material is polypropylene, polyethylene, or an acrylonitrile/butadiene/styrene terpolymer.

10. The dispensing system of claim 6, wherein said holder is molded in one unitary piece.

11. The dispensing system of claim 6, wherein said reservoir in a collapsible, disposable plastic bag.

12. The dispensing system of claim 6, wherein said reservoir further comprises a flexible tube having a nozzle at one end thereof.

13. The dispensing system of claim 7, wherein said cover has a window therein for viewing the reservoir within the dispenser.

14. A dispenser for discharging liquid materials comprising:

(a) a back portion;

(b) a cover hingedly connected to said back portion, said cover comprising a front wall having a cut-out section, and a bottom wall having an opening therein;

(c) a flexible reservoir for containing the liquid, said reservoir removably disposed in a storage portion of the dispenser;

(d) a holder demountably attached to the dispenser in the storage portion for supporting the reservoir, said holder comprising:

(i) a front wall section having an opening formed therein;

(ii) a pair of opposing spaced side wall sections positioned proximate to said front wall section;

(iii) a bottom wall section positioned proximate to said front wall and side wall sections, said bottom wall section having an aperture formed therein contiguous with said front wall opening;

(iv) means for demountably attaching said holder to said dispenser; and (v) a connecting strap on said holder which is fixedly attached to said opposing side wall sections of said holder, said strap releasably connected to said back portion of said dispenser;

wherein said front wall, side wall and bottom wall sections are operatively connected to form said holder;

(e) a flexible tube connected at its upstream end to the reservoir and containing a nozzle at its downstream end projecting through the opening in said bottom wall of said cover;

(f) support means for supporting the holder and for retaining the flexible tube; and (g) a push bar projecting through the cut-out section of the front wall of said cover, said push bar comprising an internally disposed block member;

whereby actuation of the push bar progressively urges the block member into contact with the flexible tube in order to discharge liquid through the nozzle.

15. The dispenser of claim 14, wherein said reservoir is a collapsible, disposable plastic bag.

16. The dispenser of claim 14, wherein the flexible tube has a flange positioned on the nozzle and wherein the support means has a lower slot means, said flange being inserted into said lower slot means to appropriately position the flexible tube for discharge of the liquid material.

17. The dispenser of claim 14, wherein said block member has an angled surface and is positioned on an interior surface of the front wall of said cover adjacent to the cut-out section.

18. The dispenser of claim 14, wherein the block member is in slightly pinched engagement with the flexible tube when in a non-actuated position.

19. The dispenser of claim 14, wherein the back portion contains locking means to engage the cover and maintain the dispenser in a closed position.

20. The dispenser of claim 10, wherein said locking means comprises an elongated latch movable in a channel on the back portion, said latch having a push member at a lower end thereof and receiving means at an upper end thereof.

21. The dispenser of claim 20, wherein one or more hooks are attached to the interior of the cover and engage said receiving means when the dispenser is in a closed position.

22. The dispenser of claim 14, wherein said holder is made of a plastic polymeric material.

23. The dispenser of claim 22, wherein said plastic material is polypropylene, polyethylene, or a acrylonitrile/butadiene/styrene terpolymer.

24. The dispenser of claim 14, wherein said holder is molded in one unitary piece.

25. The dispenser of claim 14, wherein said cover has a window therein for viewing the reservoir with the dispenser.

26. A reservoir holder for supporting a flexible, collapsible reservoir within a dispenser for discharging liquid materials, said holder comprising:

(a) a front wall section;

(b) a pair of opposing spaced side wall sections positioned proximate to said front wall section;

(c) a bottom wall section positioned proximate to said front wall and side wall sections, said bottom wall section having an aperture formed therein; and (d) a means for demountably attaching said holder to said dispenser, said attaching means comprising a latch protruding from said bottom wall section which can be releasably connected to said dispenser;

wherein said front wall, side wall and bottom wall sections are operatively connected to form said holder, said front and side wall sections defining an upwardly disposed access port through which the reservoir can be removed for disposal when empty and replaced with a full reservoir.

27. A liquid dispensing system, comprising:

(a) a dispenser for discharging a liquid material, comprising a housing including a back portion and a cover attached to the back portion, and a flexible reservoir for containing the liquid, said reservoir removably disposed in a storage portion of the dispenser; and (b) a holder demountably attached to the dispenser in the storage portion for supporting the reservoir, said holder comprising:

(i) a front wall section;

(ii) a pair of opposing spaced side wall sections positioned proximate to said front wall section;

(iii) a bottom wall section positioned proximate to said front wall and side wall sections, said bottom wall section having an aperture formed therein; and (iv) a means for demountably attaching said holder to said dispenser; wherein said attaching means on said holder comprises a latch protruding from said bottom wall section which is releasably connected to said dispensers;

wherein said front wall, side wall and bottom wall sections are operatively connected to form said holder, said front and side wall sections defining an upwardly disposed access port through which the reservoir can be removed for disposal when empty and replaced with a full reservoir.

28. A dispenser for discharging liquid materials comprising:

(a) a back portion;

(b) a cover hingedly connected to said back portion, said cover comprising a front wall having a cut-out section, and a bottom wall having an opening therein;

(c) a flexible reservoir for containing the liquid, said reservoir removably disposed in a storage portion of the dispenser;

(d) a holder demountably attached to the dispenser in the storage portion for supporting the reservoir, said holder comprising:

(i) a front wall section having an opening formed therein;

(ii) a pair of opposing spaced side wall sections positioned proximate to said front wall section;

(iii) a bottom wall section positioned proximate to said front wall and side wall sections, said bottom wall section having an aperture formed therein contiguous with said front wall opening;

(iv) a means for demountably attaching said holder to said dispenser, wherein said attaching means on said holder comprises a latch protruding from said bottom wall section which is releasably connected to said support means of said dispenser;

wherein said front wall, side wall and bottom wall sections are operatively connected to form said holder;

(e) a flexible tube connected at its upstream end to the reservoir and containing a nozzle at its downstream end projecting through the opening in said bottom wall of said cover;

(f) support means for supporting the holder and for retaining the flexible tube; and (g) a push bar projecting through the cut-out section of the front wall of said cover, said push bar comprising an internally disposed block member;

whereby actuation of the push bar progressively urges the block member into contact with the flexible tube in order to discharge liquid through the nozzle.

29. The dispenser of claim 28, wherein said latch has a hook member which protrudes through an upper opening in said support means to engage said support means, thereby releasably attaching said holder to said dispenser.

* * * * *

UNITED STATES PATENT AND TRADEMARK OFFICE

CERTIFICATE OF CORRECTION

PATENT NO. : 5,248,066

DATED : September 28, 1993

INVENTOR(S) : John T. Olson, Gerald L. Burns and Stanley R. Weller

It is certified that error appears in the above-identified patent and that said Letters Patent is hereby corrected as shown below:

In Column 7, claim 6, line 48, after the word "material," insert --comprising a housing including a back portion and a-- .

In Column 7, claim 6, line 55, "holding" should read --holder-- .

In Column 9, claim 20, line 17, "10" should read --19-- .

In Column 9, claim 25, line 34, "with" should read --within-- .

In Column 10, claim 27, line 12, "dispensers" should read --dispenser-- .

Signed and Sealed this

Twelfth Day of April, 1994

*Attest:*

*Attesting Officer*

Bruce Lehman

BRUCE LEHMAN

*Commissioner of Patents and Trademarks*